US006498328B2

(12) United States Patent
Anderhuber et al.

(10) Patent No.: US 6,498,328 B2
(45) Date of Patent: Dec. 24, 2002

(54) TRANSVERSE FLUX INDUCTION HEATING DEVICE WITH MAGNETIC CIRCUIT OF VARIABLE WIDTH

(75) Inventors: Marc Anderhuber, Saulny (FR); Jean-Philippe Chaignot, Belfort (FR); Claude Couffet, Montreuil (FR); Jean Hellegouarc'h, Le Perreux sur Marne (FR); Bernard Paya, Fromontville (FR); René Pierret, Metz (FR); Yves Neau, Montigny sur Loing (FR); Jean-Camille Uring, Colmar (FR); Olivier Pateau, Saint Mammes (FR); Gérard Griffay, Hauconcourt (FR); Alain Daubigny, Villerupt (FR); Philippe Roehr, Lautenbach (FR)

(73) Assignees: Celes, Lautenbach (FR); Usinor, Puteaux (FR); Electricite de France, Paris (FR)

( * ) Notice: Subject to any disclaimer, the term of this patent is extended or adjusted under 35 U.S.C. 154(b) by 0 days.

(21) Appl. No.: 09/826,190

(22) Filed: Apr. 5, 2001

(65) Prior Publication Data

US 2002/0011486 A1 Jan. 31, 2002

(30) Foreign Application Priority Data

Apr. 19, 2000 (FR) ..... 00 05062

(51) Int. Cl.[7] ..... H05B 6/36

(52) U.S. Cl. ..... 219/645; 219/646; 219/670; 219/676; 148/568; 266/129

(58) Field of Search ..... 219/645, 646, 219/656, 670, 671, 672, 673, 676; 148/567, 568; 266/129

(56) References Cited

U.S. PATENT DOCUMENTS

| | | | | |
|---|---|---|---|---|
| 4,258,241 A | * | 3/1981 | Soworowski | 219/672 |
| 4,321,444 A | * | 3/1982 | Davies | 219/676 |
| 4,484,048 A | * | 11/1984 | Travers et al. | 219/672 |
| 4,778,971 A | * | 10/1988 | Sakimoto et al. | 219/645 |
| 5,055,647 A | * | 10/1991 | Heyes et al. | 219/645 |
| 5,818,013 A | * | 10/1998 | Schluckebier | 219/645 |

* cited by examiner

*Primary Examiner*—Philip H. Leung
(74) *Attorney, Agent, or Firm*—Connolly Bove Lodge & Hutz LLP

(57) ABSTRACT

A heating device for the electromagnetic induction heating of a metal strip traveling in a specified direction. The device includes at least one electric coil arranged opposite at least one of the large surfaces of the strip so as to heat the latter by transverse magnetic flux induction, each coil being associated with at least one magnetic circuit. Each circuit is divided into a plurality of magnetically independent bars arranged parallel to the direction of travel of the strip. The bars may moved toward or away one another thereby adapting to the width of the strip and distributing the magnetic flux across the width of the strip.

6 Claims, 5 Drawing Sheets

TRANSVERSE FLUX INDUCTION HEATING DEVICE WITH MAGNETIC CIRCUIT OF VARIABLE WIDTH

FIELD OF THE INVENTION

The present invention relates to a device for the on-the-move heating, by electromagnetic induction, of magnetic or amagnetic strips of small and medium thicknesses (of the order of 0.05 to 50 millimetres). It is more particularly aimed at a transverse flux induction heating device.

BRIEF DESCRIPTION OF THE PRIOR ART

In a known manner, the on-the-move heating by electromagnetic induction of a metal strip is carried out with the aid of coils which are arranged in such a way as to surround the strip to be heated while creating a magnetic field parallel to the outer surface of this strip in the direction of travel (longitudinal flux, cf. FIG. 1*a*). A ring-like distribution is thus obtained of the induced currents which traverse the continuously moving strip in the vicinity of its peripheral surface, this giving rise to heating whose transverse temperature homogeneity is generally regarded as satisfactory.

When dealing with the heating of magnetic strips of small thickness, the efficiency of this type of heating with longitudinal flux is high. However, it drops steeply, for these materials, as soon as the Curie point temperature (around 750° C.) is exceeded. This is due in particular to the fact that the relative permeability of the material to be heated decreases rapidly during the heating process, reaching the value 1 at this same temperature. The efficiency is also limited for amagnetic materials (stainless steel, aluminium, etc.), regardless of the temperature of the product.

According to another known solution for the on-the-move induction heating of flat metal products, two coils are arranged on either side of the product to be heated up, opposite each of the large faces thereof so as to create a magnetic field perpendicular to the large faces of the product according to the so-called transverse flux technique (cf. FIG. 1*b*).

The main drawback of this type of plant lies in the fact that the looped distribution of the currents induced by the crosswise magnetic flux does not generally allow a satisfactory temperature homogeneity to be achieved, in particular the ends in the width direction of the strip (the edges) are heated excessively or insufficiently depending on the relative dimensions of the coils and of the magnetic circuit which are used as compared with the strip width.

To solve this problem, the use has already been proposed of transverse flux electromagnetic induction heating in which the inductors comprise magnetic circuits. The latter are intended to guide the magnetic flux generated by the coils so as to act on the distribution of the induced currents.

However, such devices have the disadvantage of not being easily modifiable so as to adapt to the widths of strip to be heated. To counter such a drawback, there is known for example an electromagnetic induction heating device described in American Patent No. 4,678,883 in which the inductors consist of a plurality of mutually coupled magnetic bars (the term "coupled" is understood to mean bars which co-operate with one another such that the magnetic flux produced by the inductors can pass from one bar to the other bar), which are arranged parallel to the direction of movement of the strip to be heated and can be individually moved perpendicularly to the surface of the said strip in such a way as to adapt the flux distribution to the width of the strip, according to the latter's dimensions.

Now, even this type of electromagnetic induction heating does not allow correct control of the temperature fluctuations in the vicinity of the edges of the strip to be heated. Specifically, the magnetic bars set back with respect to the said strip continue to exert an influence, albeit weaker, on the magnetic flux distribution and hence on the temperature and as a result of this the temperature distribution curve shows a concentration of the currents induced on the edges.

Moreover, likewise known is EP-A-0 667 731 which discloses a transverse flux electromagnetic induction heating device in which the length of the coils is varied so as to adapt the flux distribution to the strip widths. To do this, this document proposes that these coils be made by assembling two J-shaped opposed inductors which can translate freely in a direction parallel to the strip width. As in the American patent mentioned above, this device does not make it possible to obtain very satisfactory transverse temperature homogeneity.

BRIEF DESCRIPTION OF THE INVENTION

In view of the drawbacks of the solutions of the prior art recalled hereinabove, the present invention proposes to provide an original solution by making a transverse flux electromagnetic induction heating device whose magnetic circuit, made with a plurality of independent magnetic bars, adapts to the width of the strip to be heated. This device thus makes it possible to improve the thermal homogeneity in the width direction of the strip to be heated.

Accordingly, the invention provides a device for the electromagnetic induction heating of a metal strip travelling in a specified direction comprising at least one electric coil arranged opposite at least one of the large faces of the said strip so as to heat the latter by transverse magnetic flux induction, each coil being associated with at least one magnetic circuit, each circuit being divided into a plurality of mutually uncoupled magnetic bars arranged parallel to the direction of travel of the strip, the said device being characterized in that the said magnetic circuit, consisting of the said plurality of mutually independent bars, adapts to the width of the strip to be heated by moving the said bars away from or towards one another, in such a way as to continuously adapt the distribution of the said magnetic flux to the characteristic dimensions of the said strip.

Thus, by virtue of the present invention, regardless of the width of the strip to be heated, the volume and hence the weight of the magnetic circuit remains invariable.

According to an advantageous characteristic of the invention, the electromagnetic induction heating device also comprises screens made of materials of good electrical conductivity placed in the gap on either side of the strip and in the vicinity of the latter's edges, in such a way as to optimize the homogeneity of the transverse temperature.

According to another advantageous characteristic of the invention, the surface of the magnetic circuit which is opposite one of the large faces of the strip to be heated is given a suitable "polar" profile (bisinusoidal for example) by fashioning the magnetic laminations constituting this circuit such as to obtain a better distribution of the magnetic flux, and more especially in the vicinity of the edges of the said strip. The term "polar" profile is understood to mean a surface of the magnetic circuit which is curved in the three directions in space.

Other characteristics and advantages of the present invention will emerge from the description given hereinafter, with reference to the appended drawings which illustrate exemplary embodiments and applications thereof, devoid of any limiting character.

DETAILED DESCRIPTION OF THE INVENTION

Figure 1A:
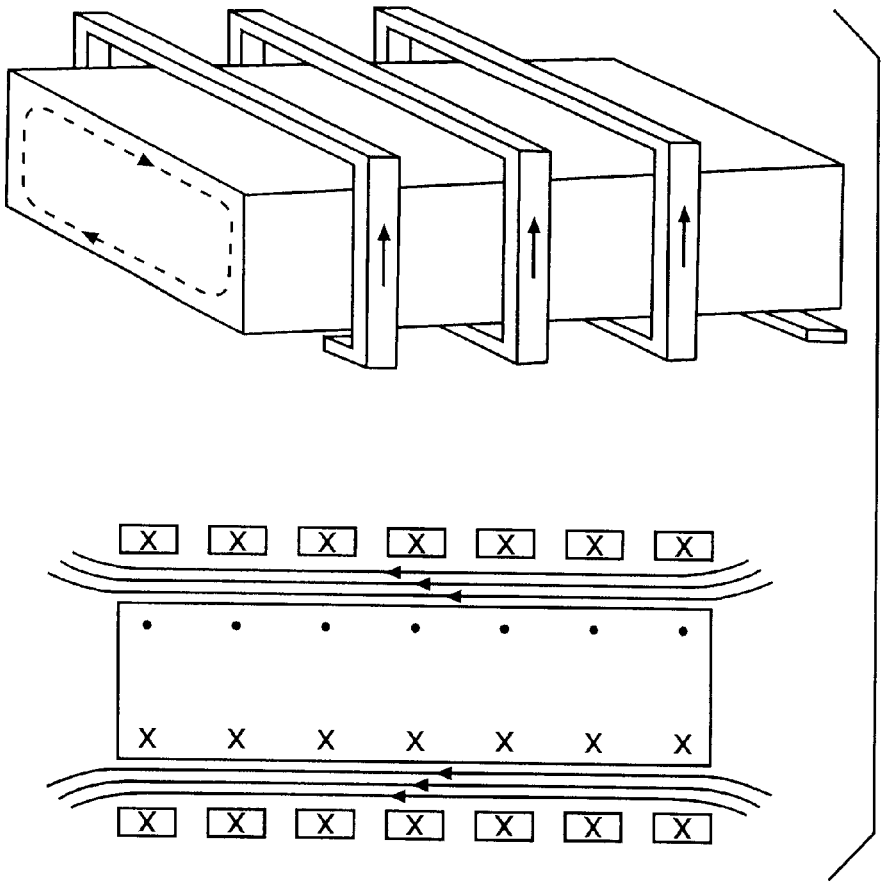
FIG. 1A PRIOR ART
FIGS. 1*a* and 1*b* illustrate electromagnetic induction heating devices known from the prior art, with longitudinal flux and transverse flux respectively.
Figure 1B:
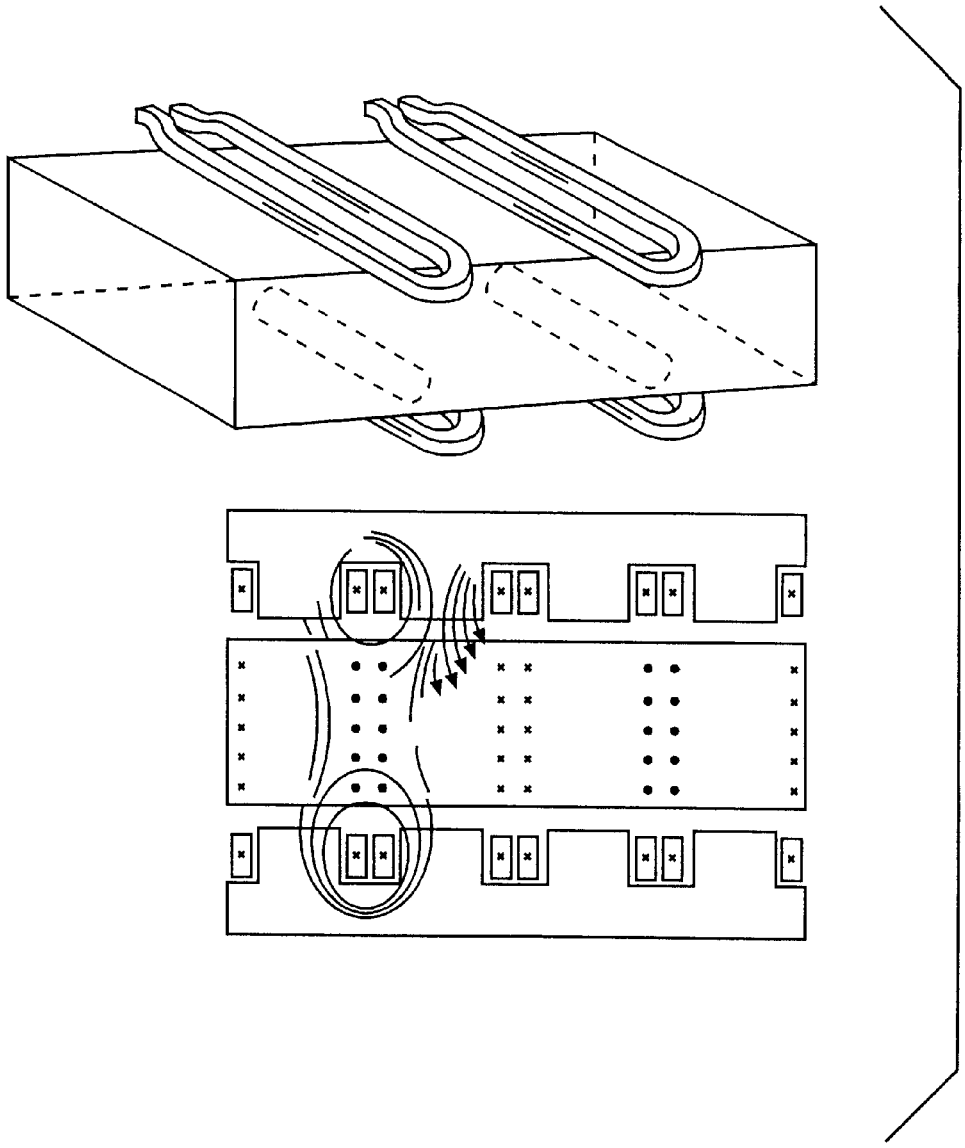
FIG. 1b PRIOR ART
Figure 2A:
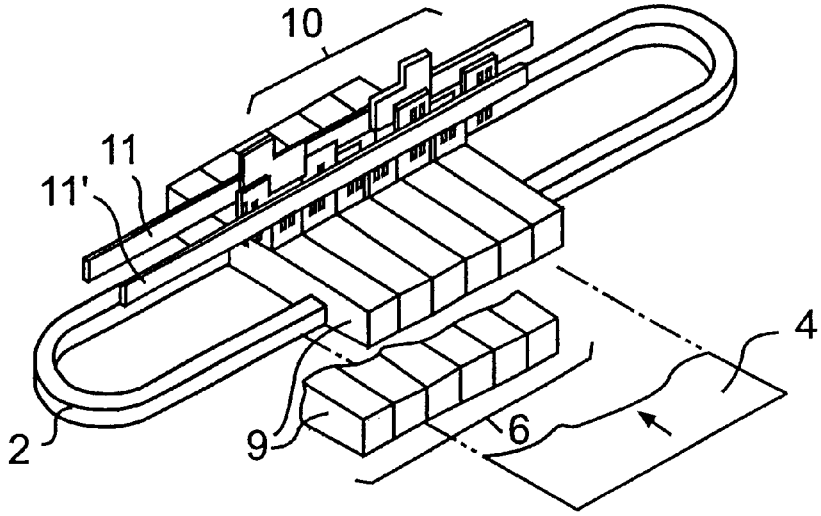
FIGS. 2*a* and 2*b* are partial perspective views of the induction heating device according to the invention in two positions.
Figure 2B:
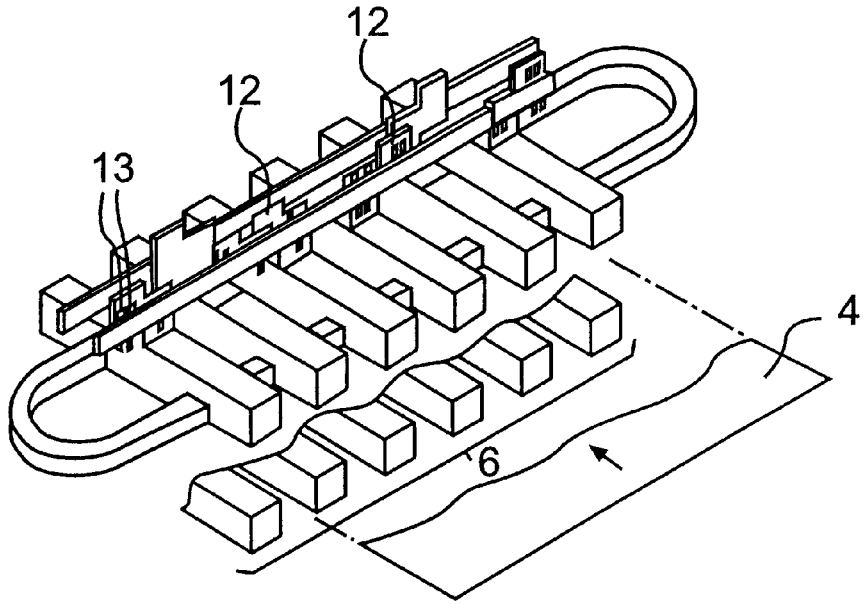

Referring to the drawings, and more especially to FIGS. 2*a* and 2*b*, it may be seen that the transverse flux electromagnetic induction heating device according to the present invention comprises in particular two magnetic armatures 1 and 1' respectively which are provided with at least one electric coil 2 and are arranged face-to-face on either side of a strip 4 to be heated. The latter can for example be guided in the gap defined between the magnetic circuits with the aid of rolls (not represented) and thus be transferred into the heating zone. Its movement is generally continuous during the heating process according to the invention.

As a variant, and according to the desired application of this heating device, it is possible to arrange at least one magnetic armature 1 provided with at least one electric coil 2 opposite just one of the large faces of the strip 4 to be heated.

According to the known so-called transverse flux technique, the magnetic flux produced by the electric coils 2 crosses the strip to be heated 4 and induces in the latter a current which flows in the plane of the said strip and which closes up in a loop in the vicinity of the edges. To do this, the coil or coils 2 are energized with the aid of an AC current of medium frequency (for example, of the order of 50 to 20,000 Hz approximately).

To ensure the guidance of the magnetic flux produced by the coils 2 in particular in the vicinity of the edges of the said strip, a magnetic circuit 6 is arranged over all of or a part of the length of the said coils. This circuit consists of a plurality of magnetic bars 8 arranged parallel to the direction of travel of the strip 4 to be heated.

According to the invention, the bars 8 making up the magnetic circuit 6 are not coupled together and are arranged mutually parallel to one another. These bars are therefore mutually independent and they are also independent of the electric coils. Furthermore, they can slide with the aid of means 10 in the vicinity of the electric coils 2 in such a way as to move away from or towards one another, the electric coils remaining stationary. Thus, the spacing between two adjacent bars can be enlarged or narrowed, continuously, under the action of the said means 10. As a result of this, the magnetic flux distribution can be adapted to the dimensions of the strip 4, and in particular to its width (cf. FIG. 2*b*).

This essential characteristic of the present invention makes it possible to obtain, not only an induction heating device which can be adapted to various widths of the strip to be heated, but above all the thermal homogeneity obtained in the width direction of the said strip remains optimal irrespective of the width of the latter.

Specifically, the spatial positioning of the magnetic bars which is associated with a suitable polar profile makes it possible to act on the flow of the induced currents and hence to control the transverse temperature distribution.

The means 10 making it possible to continuously slide the magnetic bars 8 in the vicinity of the electric coils 2, but without moving the latter, consist in particular of at least two parallel rails 11 and 11' arranged on each side of the surface of the strip 4 and perpendicularly to the latter's direction of movement. These rails support a plurality of armatures 12, each of these armatures being fixed to at least one bar 8. Preferably, the support of the armatures of two adjacent bars on the two rails 11 and 11' is alternated in such a way as to reduce the overall dimensions when the width of the magnetic circuit 6 is a minimum (case where the spacing between the bars is a minimum). The armatures will slide on the rails with the aid of rollers 13 or the like in a mutually independent manner, thus allowing very accurate, optimal and continuous adjustment of the width of the magnetic circuit and hence of the flux distribution. Thus, a width of the magnetic circuit varying from 800 to 1500 millimetres can be achieved for example.

According to an advantageous characteristic of the invention, the spacing between two adjacent magnetic bars 8 can be adjusted manually or automatically so as to obtain the desired magnetic distribution.

Figure 3A:
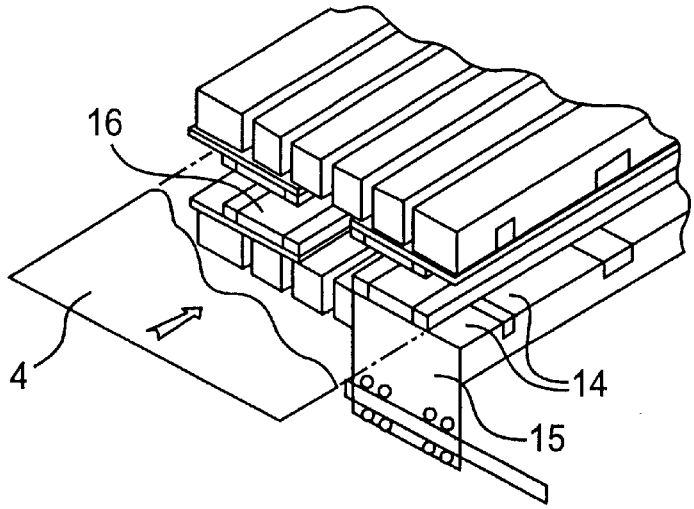
FIGS. 3*a* and 3*b* are partial perspective views of the device of FIG. 1 fitted with screens made of materials of good electrical conductivity, coupled to magnetic pads.
Figure 3B:
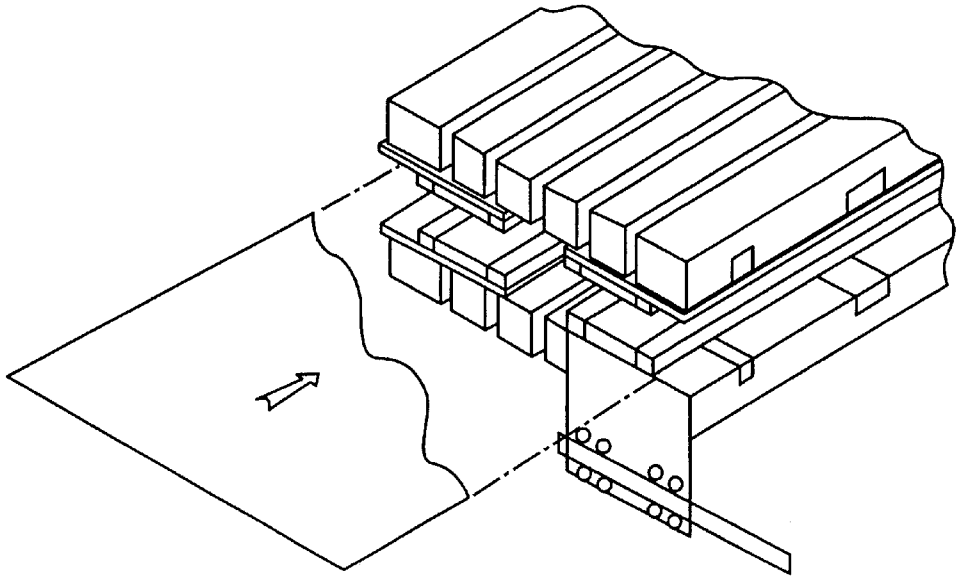

According to another advantageous characteristic of the invention (cf. FIGS. 3*a* and 3*b*), in order to optimize the homogeneity of the transverse temperature of the strip to be heated, screens 14 are arranged in the gap on either side of the said strip and in the vicinity of the latter's edges. Such screens are made from material possessing good electrical conductivity such as for example copper, aluminium or silver. Their function is to adjust the magnetic flux in the vicinity of the edges of the strip so as to control the temperature of the edges of the said strip.

Furthermore, these screens are also fixed on armatures 15 supported by rails by way of rollers or the like in such a way that a translational motion can be imparted to them along the width of the strip used. As a variant, these screens can also be fixed directly on the end magnetic bars which are opposite the edges of the strip to be heated.

According to yet another advantageous characteristic of the invention, magnetic pads 16 can also be arranged on the armatures 15 supporting the screens 14 in such a way as to hone the distribution of the magnetic flux over the width of the strip, in particular such pads make it possible to offset any temperature heterogeneities. These magnetic pads 16 can be coupled to the screens 15 of good electrical conductivity and/or to the magnetic bars 8 or else be arranged without screens.

Figure 4:
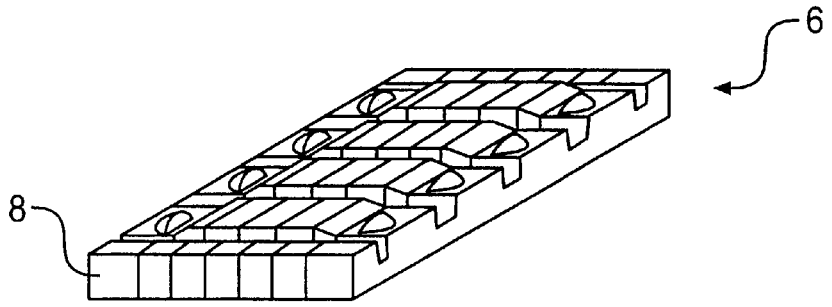
FIG. 4 is a partial schematic view of an exemplary polar profile (surface of the magnetic circuit opposite the strip to be heated)

According to yet another advantageous characteristic of the invention (cf. FIG. 4), the surface of the magnetic circuit 6 of each armature (1, 1') which is opposite one of the large faces of the strip 4 is given a "polar" profile, adapted such as to obtain a controlled distribution of the magnetic flux generated by the electric coils 2, in particular in the vicinity of the edges of the said strip.

According to yet another advantageous characteristic of the invention, a short-circuited turn (not represented) is added on either side of the heating device, perpendicularly to the bars of the magnetic circuit and enwrapping the moving strip so as to reduce the leakage magnetic fields at the ends of the inductor.

An advantageous exemplary application of the electromagnetic induction heating device according to the invention will now be described.

Figure 5:
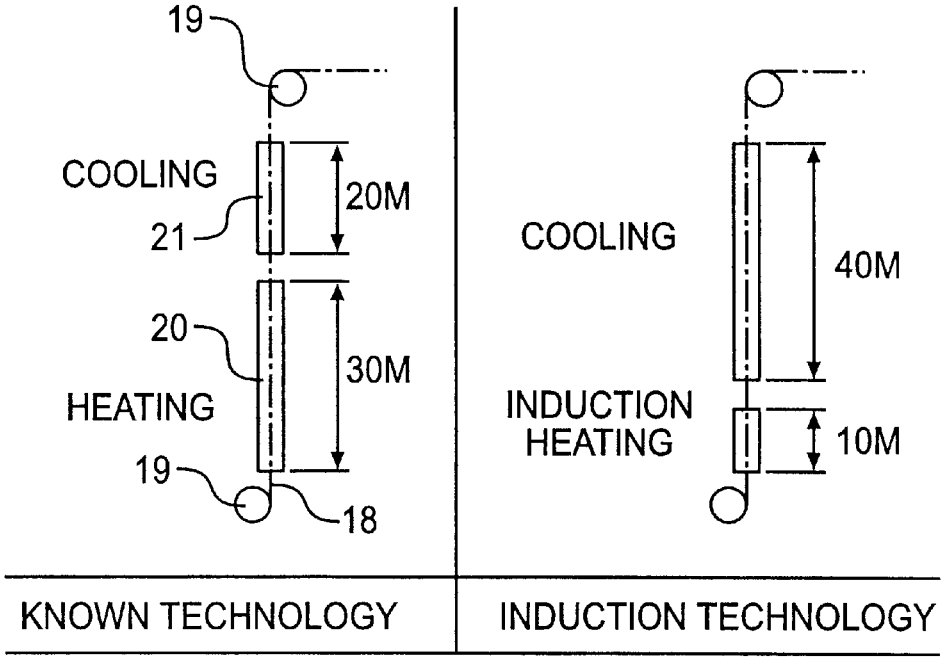
FIG. 5 is a partial schematic view of a conventional plant for the bright annealing of stainless steel.

FIG. 5 represents a partial schematic view of a plant for the bright annealing of, for example, stainless steel. Such an annealing line is arranged as a single vertical run whose total height must not exceed 50 meters approximately. Over this height, the strip to be heated 18, which is guided by rolls 19, crosses firstly a heating zone 20 then a cooling zone 21. In a known manner in respect of a nonmagnetic steel strip, the latter enters the heating zone at ambient temperature (20° C. approximately), must emerge therefrom at a temperature of 1150° C. and then be cooled so as to reach a temperature of 100° C. at the end of the line.

Heating devices employing gas or electrical resistors are known, the height of which over such a line is approximately 30 meters, this leaving little room for the cooling of the strip. Consequently, such devices operate with a speed of movement of the strip to be heated typically of the order of 60 meters per minute.

The electromagnetic induction heating device according to the invention applied to such a plant has the advantage of being able to reduce the overall height dimension of the heating zone to approximately 10 meters, thereby affording much more room for cooling and thus making it possible to reach a line speed of 120 meters per minute for stainless steel having a thickness of approximately 0.5 millimetres.

The present invention as described above therefore offers multiple advantages. It makes it possible on the basis of an electromagnetic induction heating device using variable-width magnetic circuits to create a magnetic flux of high intensity for medium frequencies. This magnetic flux density makes it possible to achieve a power density transmitted to the strip to be heated greater than that of the known heating means. Furthermore, the electrical efficiency of this device is superior to that of the known technology. Additionally, such a device makes it possible to obtain satisfactory thermal homogeneity in the width direction of the strip.

What is claimed is:

1. A heating device for the electromagnetic induction heating of a metal strip traveling in a specified direction comprising:

at least one electric coil located opposite at least one of two large sides of the strip so as to heat the strip by transverse magnetic flux induction;

each coil being associated with at least one magnetic circuit;

each circuit being divided into a plurality of magnetically independent bars;

the bars being positioned parallel to the direction of travel of the strip;

the bars being independently movable relative to one another to adapt to the width of the strip to be heated;

movement of the bars permitting distribution of magnetic flux across the entire width of the strip.

2. A heating device according to claim 1, comprising electrically conductive screens located in a gap defined by first and second sets of magnetic circuits that are respectively located opposite the large sides of the strip and laterally disposed in the vicinity of lateral edges of the strip so as to adjust the magnetic flux in the vicinity of the strip edges.

3. A heating device according to claim 1, comprising magnetic pads arranged in the gap defined by first and second sets of magnetic circuits that are respectively located opposite large surfaces of the strip and laterally disposed in the vicinity of lateral edges of the strip to optimize a distribution of the magnetic flux over the width of the strip.

4. A heating device according to claim 1, further comprising at least one rail opposite each large side of the strip, and perpendicular to the direction of travel of the latter, the rail supporting with the aid of rollers, a plurality of armatures, each of the armatures being fixed to at least one magnetic bar for allowing the armatures supporting the bars to be moved away from or towards one another by sliding on the rails.

5. A heating device according to claim 4, wherein the surface of the magnetic circuit of each armature which is opposite one of the large sides of the strip possesses a polar profile to enable generation of a controlled distribution of the magnetic flux.

6. A heating device according to claim 4, further comprising at least one short-circuited turn arranged on either side of the armature such as to enwrap the strip for reducing magnetic field leakage at the ends of the device.

* * * * *